United States Patent [19]

Konishi

[11] Patent Number: 5,074,746

[45] Date of Patent: Dec. 24, 1991

[54] CONSTANT SPEED VERTICAL PUMP WITH AERATION

[75] Inventor: Masahide Konishi, Hirakata, Japan

[73] Assignee: Kubota Corporation, Osaka, Japan

[21] Appl. No.: 602,857

[22] Filed: Oct. 24, 1990

[30] Foreign Application Priority Data

Oct. 31, 1989 [JP] Japan ..... 1-284025

[51] Int. Cl.[5] ..... F04B 11/00; F04B 39/00; F04B 49/00

[52] U.S. Cl. ..... 415/24; 417/36; 417/90

[58] Field of Search ..... 415/24, 115, 116, 169.1, 415/182.1, 183, 208.1, 914; 417/36, 90

[56] References Cited

U.S. PATENT DOCUMENTS

| | | | |
|---|---|---|---|
| 1,474,086 | 11/1923 | Poebing | 415/24 |
| 1,785,480 | 12/1930 | Durdin, Jr. | 415/24 |
| 2,510,190 | 6/1950 | Nicolette | 415/24 |
| 3,324,803 | 6/1967 | Kelley et al. | 417/90 |
| 4,204,801 | 5/1980 | Kamo | 417/36 |
| 4,781,529 | 11/1988 | Rose | 415/169.1 |

FOREIGN PATENT DOCUMENTS

| | | | |
|---|---|---|---|
| 032973 | 2/1983 | Japan | 415/182 |

*Primary Examiner*—Edward K. Look
*Assistant Examiner*—Michael S. Lee
*Attorney, Agent, or Firm*—Jones, Tullar & Cooper

[57] ABSTRACT

According to the vertical pump of the present invention, a reverse U-shape air suction passage is connected to a suction casing which communicates with the impeller chamber, and a U-shape branch passage is branched from a hanging portion of the air suction passage. According to this vertical pump, when the water level is raised in the air operation state, air suction into the suction casing through the air suction passage and the branch passage is stopped when the water level reaches the pumping starting water level, so that the operation of the vertical pump may be changed to the water pumping operation. Where the water level is lowered in the state of water pumping operation, air suction into the suction casing through the branch passage and the air suction passage may start at the pumping stopping water level which is lower than the pumping starting water level. Accordingly, the operation of the vertical pump may be changed to the air operation. The provision of the air suction passage and the branch passage enables the vertical pump to carry out the full-speed operation at all times.

17 Claims, 8 Drawing Sheets

CONSTANT SPEED VERTICAL PUMP WITH AERATION

BACKGROUND OF THE INVENTION

1. Field of the Invention

The present invention relates to a vertical pump which is to be installed in a water pumping well in a drainage plant or the like and in which a full-speed operation may be carried out regardless of the level of water.

2. Description of the Invention

A general-type vertical pump installed in a water pumping well or the like presents the lowest water level (the operable lowest water level) LWL where, even though the suction port is located in water, there are produced eddies so that water mixed with air is sucked. The lowest water level LWL is inherent in each pump. When a conventional vertical pump is operated before the water level reaches the lowest water level LWL, the pump inevitably produces vibration or noise. Accordingly, when such a general-type vertical pump is operated at a full speed (full-speed waiting operation) regardless of the water level in the water pumping well, causing the pump to stand ready for an unforeseen flood, there are instances where, while the water level is below the lowest water level LWL, the pump produces strong vibration and noise, causing the pump to be functionally disordered. In this connection, the conventional vertical pump of the general type is so arranged as not to carry out the full-speed waiting operation, and adopts an operation system in which the pump is operated only when the water level is higher than the lowest water level LWL and stops operating when the water level is lower than the lowest water level LWL.

Recently, the ground layer is decreased in water retention due to decrease in green zone and increase in pavement accompanied by the development of urbanization. It is therefore remarkable that the amount of water flowing into the water pumping well or the like is apt to be increased. Further, it often occurs that a great amount of water suddenly and unexpectedly flows into the water pumping well as is the case of a so-called flash flood. Accordingly, the water level in the water pumping well or the like varies in a short period of time. In the operation system using the conventional vertical pump of the general type as above-mentioned, it is difficult to properly control the operation starting and stopping timings of the vertical pump. This involves the likelihood that an abnormal rise in water level causes a flood or an abnormal descent of water level causes the pump to be functionally disordered.

In view of the foregoing, the Applicant has proposed a vertical pump capable of carrying out a stable full-speed waiting operation regardless of the water level which is either higher or lower than the lowest water level LWL, as disclosed by Japanese Patent Laid-Open Publication SHO 63/134897.

FIG. 7 shows the vertical pump disclosed by this Japanese Patent Laid-Open Publication SHO 63/134897. In this vertical pump, a suction pipe 603 having one end opened in the air, communicates with a suction casing 602 disposed at the forward (upstream) of a pump impeller. A suction valve 604 is disposed at the tip of the suction pipe 603. The suction valve 604 is adapted to be controlled as opened or closed by a signal from a water level detector 605. This vertical pump may carry out a full-speed waiting operation and controlled in the following manner.

In the case where the water level in a water pumping well P is raised from a position lower than the lowest water level LWL, the suction valve 604 is opened while the water level detector 605 detects that the water level does not reach the lowest water level LWL, and the suction valve 604 is closed when the water level detector 605 detects that the water level in the water pumping well P has reached the lowest water level LWL. According to such a control, until the water level reaches the lowest water level LWL, air is sucked from the suction pipe 603 to the impeller chamber 606 so that water is not pumped up. Thus, a so-called air operation at a full speed is smoothly continued. On the other hand, after the water level has reached the lowest water level LWL, the air suction from the suction pipe 603 to the impeller chamber 606 is stopped and water is pumped up. Thus, a normal water pumping operation is carried out.

In the case where the water level in the water pumping well P is lowered from a position higher than the lowest water level LWL, while the water level detector 605 detects that the water level does not reaches the lowest water level LWL, the suction valve 604 remains closed so that the water pumping operation is continued. On the other hand, when the water level detector 605 detects that the water level has reached the lowest water level LWL, the suction valve 604 is opened and air is sucked to the impeller chamber 606 through the suction pipe 603 so that water pumping is stopped and the operation is changed to the air operation.

As described in the foregoing, the vertical pump disclosed by this Japanese Patent Laid-Open Publication SHO 63/134897 is so arranged as to carry out such a full-speed waiting operation as to cope with sudden rise or descent of water level. It is therefore possible to prevent a flood from being caused by an abnormal rise in water level and to also prevent the pump from being functionally disordered due to an abnormal descent of water level.

However, this vertical pump presents the problem that the water level detector 605 is susceptible to an influence of water quality, dust or the like. Further, the suction valve 604 requires an external drive source and a sequence control unit for operating this drive source.

To solve the problems above-mentioned, the Applicant has proposed a vertical pump capable of carrying out a stable full-speed waiting operation, regardless of the water level which is higher or lower than the lowest water level LWL, without use of the water level detector and the suction valve. FIG. 8 shows such a vertical pump.

In the vertical pump shown in FIG. 8, a suction pipe 703 is made in a reverse U-shape and the lower open end 707 of the inside passage of the pipe 703 is located in a level identical with or in the vicinity of the lowest water level LWL. A turned portion 708 of the reverse U-shape suction pipe 703 is located in a position higher than the pumping head corresponding to a maximum negative pressure generated in the suction part of an impeller chamber 706 when an impeller 701 is operated at a full speed.

When the water level in a water pumping well P is raised from a position lower than the lowest water level LWL, the vertical pump in FIG. 8 is operated in the following manner. While the water level does not reach the lower open end 707, air is sucked from the lower open end 707 to the impeller chamber 706 through the suction pipe 703. Accordingly, no water is pumped up but a full-speed air operation is smoothly continued. When the water level is further raised and reaches the lowest water level LWL, the lower open end 707 is sealed with water. While the air remaining in a bell-mouth 709, a suction casing 702 and the suction pipe 703 is sucked, the operation of the vertical pump is quickly changed to the water pumping operation. At the time when the air remaining in the suction casing 702 is perfectly sucked, a perfect water pumping operation starts. The turned portion 708 of the suction pipe 703 is located in a position higher than the pumping head corresponding to a maximum negative pressure generated in the impeller chamber 706. Accordingly, during the water pumping operation, water is pumped up in the hanging portion 710 of the suction pipe 703 to such a height as to be kept in equilibrium with a negative pressure in the impeller chamber 706. In this connection, no water is fed from the suction pipe 703 to the impeller chamber 706. Thus, water is pumped up through the suction casing 702 to achieve a smooth water pumping operation.

On the other hand, where the water level in the water pumping well P is lowered from a position higher than the lowest water level LWL during the full-speed operation of the vertical pump, the vertical pump is operated in the following manner. When the water level does not reach the lower open end 707, the lower open end 707 remains sealed with water so that the water pumping operation is continued. Meanwhile, water is pumped up in the hanging portion 710 of the suction pipe 703 to such a height as to be kept in equilibrium with a negative pressure of the impeller chamber 706. When the water level reaches the lowest water level LWL and the water sealing of the lower open end 707 of the suction pipe 703 is released, the water pumped in the hanging portion 710 falls and the suction pipe 703 is opened in the entire length thereof. Accordingly, air is sucked from the lower open end 707 to the impeller chamber 706 through the suction pipe 703. With such air suction, the water pumping operation in the suction casing 702 and the like is stopped, so that the operation of the vertical pump is quickly and smoothly changed to the air operation.

Thus, the vertical pump as shown in FIG. 8 may stand ready in a full-speed operation state for sudden rise or descent of the water level. It is therefore possible to prevent a flood from being caused by an abnormal rise in water level and to prevent the pump from being functionally disordered due to abnormal descent of water level. Further, it is not required for the vertical pump in FIG. 8 to use the water level detector 605 and the suction valve 604 discussed in connection with FIG. 7. Accordingly, the vertical pump in FIG. 8 eliminates the problems that the water level detector 605 is susceptible to an influence of water quality, dust or the like and that the control unit is somewhat complicated. Thus, the vertical pump may securely cope with an unexpected flood or the like.

In the vertical pump in FIG. 8, however, when the water level in the vicinity of the lowest water level LWL varies at a low speed or the water surface undulates in the vicinity of the lowest water level LWL, the lower open end 707 of the suction pipe 703 is repeatedly submerged under water or opened in the air in a short period of time. In such a case, there are instances where the open area or the open time of the lower open end 707 at the time when the lower open end 707 is opened in the air, is insufficient. This may cause a so-called hunting phenomenon where an insufficient air suction to the impeller chamber 706 through the suction pipe 703 is intermittently made in a short period of time. If such a hunting phenomenon occurs, the changeover from the air operation to the water pumping operation or from the water pumping operation to the air operation may not be smoothly carried out. This involves the likelihood that a force is exerted to the impeller 701 to cause the pump to be functionally disordered. Such a hunting phenomenon often occurs particularly when the water level in the water pumping well P is lowered from a position higher than the lowest water level LWL so that the water pumping operation is changed to the air operation. More specifically, the changeover from the air operation to the water pumping operation and vice versa during the full-speed waiting operation, is carried out based on the level of the lower open end 707 which is identical with or in the vicinity of the lowest water level LWL. Accordingly, if the open area or open time of the lower open end 707 is insufficient, it is not possible to assure air to be sucked to the suction casing 702 in such a sufficient amount as to quickly stop the water pumping operation which has been carried out up to that time.

SUMMARY OF THE INVENTION

In view of the foregoing, the present invention is proposed with the object of providing a vertical pump in which the changeover from the air operation to the water pumping operation is made based on a water level different from the water level based on which the water pumping operation is changed to the air operation, thereby to assure the function of full-speed waiting operation of the vertical pump discussed in connection with FIG. 8, yet preventing the occurrence of the hunting phenomenon mentioned earlier.

It is another object of the present invention to provide a vertical pump of which installation space may be relatively reduced.

It is a further object of the present invention to provide a vertical pump which is free from the influence of foreign matter, such as vinyl pieces or the like, floating on the water surface.

To achieve the objects above-mentioned, the vertical pump in accordance with an embodiment of the present invention comprises:

an air suction passage in the form of a reverse U-shape formed by a standing portion, a turned portion and a hanging portion, the peripheral surface of the passage being entirely closed, the standing portion being connected, at the lower end thereof, to a suction casing which communicates with an impeller chamber, the lower end opening of the hanging portion being located in a position lower than the lowest water level of the vertical pump, the turned portion being located in a position higher than the pumping head corresponding to a maximum negative pressure generated in the impeller chamber; and a passage having a U-shape portion and branched from the hanging portion of the air suction passage, the end opening of the passage being located in a position higher than the lowest water level of the vertical pump.

The vertical pump having the arrangement above-mentioned will be operated in the following manner according to variations of the water level, so that the full-speed waiting operation may be carried out at all times.

When the water level is raised from a position lower than the lowest water level, the vertical pump is operated in the following manner. Until the water level reaches the end opening of the branch passage, air is sucked from the lower end opening of the hanging portion of the air suction passage or from the end opening of the branch passage into the impeller chamber through the hanging portion or the branch passage, so that the air operation is carried out. When the water level reaches the end opening of the branch passage or the branched portion of the branch passage so that the branch passage is sealed with water, the air suction to the impeller chamber is stopped. Accordingly, the self-priming of the impeller causes water to be sucked from the suction casing to the impeller chamber, so that the water pumping operation is carried out. During the water pumping operation, water is pumped up in the hanging portion of the air suction passage to such a height as to be kept in equilibrium with the negative pressure in the impeller chamber. When water pumping starts, the water pumping operation is continued as far as the water level is located in a position higher than the water level at this time, i.e., the pumping starting water level.

On the other hand, when the water level is lowered from a position higher than the lowest water level, the vertical pump is operated in the following manner. First, before the water level reaches the pumping starting water level, the water pumping operation which has been made up to that time, is continued. While the water level is located in a position between the pumping starting water level and the lowest water level, the vertical pump is still maintained in the state where the branch passage remains sealed with water. Accordingly, the water pumping operation is continued. When the water level is further lowered and reaches the lowest water level, the water column formed in the hanging portion of the air suction passage and the branch passage becomes ill-balanced. This causes the water sealing of the branch passage to be released. With such a release, air is sucked from the end opening of the branch passage into the impeller chamber. Accordingly, the water pumping operation in the suction casing is stopped so that the operation of the vertical pump is changed to the air operation. The water level at that time is called a pumping stopping water level. A portion of the water which is being pumped up in the hanging portion, is pumped up to the impeller chamber, while another portion of the water falls in the hanging portion by its own weight. This another portion of the water is discharged through the lower end opening of the hanging portion without entering the branch passage. Accordingly, there is no likelihood that the U-shape branch passage is again closed due to water entering therein.

As thus discussed, the vertical pump having the arrangement above-mentioned may maintain the function of full-speed waiting operation of the vertical pump shown in FIG. 8, as it is. Further, it is possible to provide a predetermined difference between the pumping starting water level based on which the air operation is changed to the water pumping operation, and the pumping stopping water level based on which the water pumping operation is changed to the air operation. This prevents the occurrence of the hunting phenomenon at the time when the water pumping is stopped. Accordingly, the vertical pump of the present invention may stand ready in the full-speed operation state for sudden rise or descent of water level. Further, it is possible to prevent a flood from being caused by an abnormal rise in water level and to also prevent the pump from being functionally disordered due to an abnormal descent of water level.

Further, the vertical pump of the present invention uses neither a water level detector nor a suction valve, thus simplifying the arrangement and enhancing the operational reliability. Accordingly, the vertical pump may satisfactorily deal with sudden rise or descent of the water level.

In a vertical pump in accordance with another embodiment of the present invention, the branch passage is formed by a pipe curved in a U-shape. This vertical pump may achieve, in a very simple arrangement, the operational effects achieved by the vertical pump according to the first-mentioned embodiment of the present invention.

In a vertical pump in accordance with a further embodiment of the present invention, at least the lower part of the hanging portion of the air suction passage is formed by a pipe. This vertical pump comprises:

a casing portion surrounding a portion of the pipe forming the hanging portion of the air suction passage with a distance provided between the outer peripheral surface of the pipe and the casing portion;

a bottom plate which closes the lower end of a tubular space formed between the casing portion and the outer peripheral surface of the tube; and partitioning plates disposed between the casing portion and the pipe for dividing the space above-mentioned into a plurality of space portions with the lower ends of the partitioning plates separated from the bottom plate, the upper end of at least one of the space portions communicating with only the air suction passage in the pipe and the upper end of at least one of another space portions being opened in the air, so that these two space portions form the branch passage.

According to the vertical pump having the arrangement above-mentioned, the space required for forming the branch passage may be reduced. This is advantageous in that the vertical pump may be made in a compact design and improved in appearance.

In a vertical pump in accordance with still another embodiment of the present invention, at least the lower part of the hanging portion of the air suction passage is formed by a pipe. This vertical pump comprises:

a box-type casing attached to the pipe forming the hanging portion of the air suction passage, the box-type casing having a bottom;

a first partitioning plate disposed inside of the box-type casing for partitioning the inside space thereof to form the branch passage;

a second partitioning plate disposed inside of the box-type casing for forming a vertical passage which communicates with the upper portion of one part of the branch passage formed as partitioned by the first partitioning plate and which is formed for downwardly extending the hanging portion of the air suction passage;

a cover secured to the pipe above-mentioned for closing the upper opening of the box-type casing; and an opening formed in the bottom of the box-type casing such that the opening forms the lower end opening of the hanging portion which downwardly extends through the vertical passage, or such that the opening communicates with the lower end opening above-mentioned.

According to the vertical pump having the arrangement above-mentioned, the portion forming the branch passage may be made in a compact design and improved in appearance.

According to the vertical pump above-mentioned, the end opening of the branch passage may be downwardly opened. Such an arrangement prevents the end opening from being closed by or clogged with foreign matter floating on the water surface such as vinyl pieces, dust or the like, when the water level is lowered from a position higher than the end opening of the branch passage.

Such clogging of the branch passage with foreign matter may be more securely prevented by locating the end opening of the branch passage in a position higher than the highest water level of a water pumping well in which the vertical pump is installed. According to the vertical pump having the arrangement above-mentioned, when the water level in the water pumping well is raised and reaches a position higher than that portion of the branch passage which is branched from the air suction passage, the branch passage is sealed with water which flows into the branch passage through this branch portion, so that the water pumping operation starts.

Various other features and effects of the present invention will be apparent from the following description of embodiments thereof.

DETAILED DESCRIPTION OF THE PREFERRED EMBODIMENTS

Figure 1:
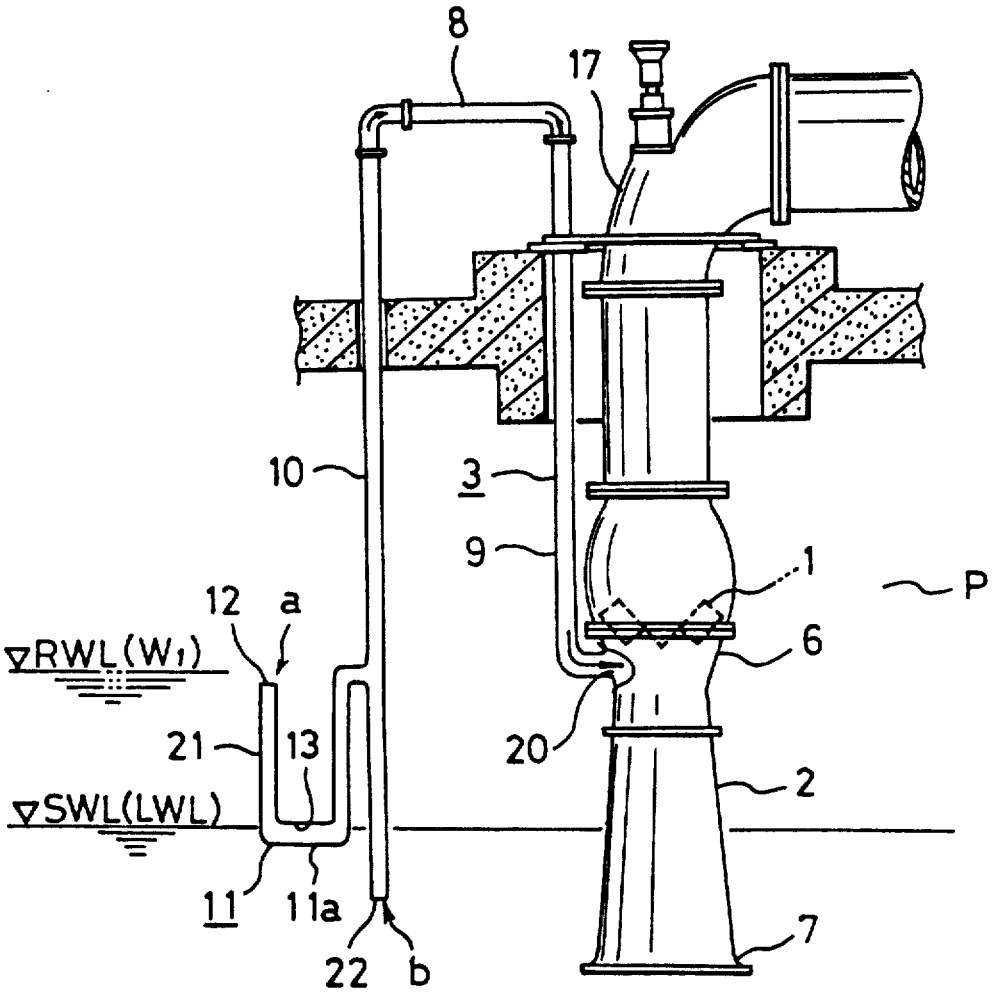
FIG. 1 is a schematic view illustrating the arrangement of a vertical pump in accordance with an embodiment of the present invention.

FIG. 1 shows a vertical pump in accordance with an embodiment of the present invention.

The vertical pump has a pump impeller 1, a suction casing 2 disposed forward (upstream) of the impeller 1 and an air suction pipe 3 of which inside passage communicates with the inside of the suction casing 2, the air suction pipe 3 being connected to the suction casing 2. The air suction pipe 3 has a diameter considerably smaller than that of a suction port 7. The air suction pipe 3 is made in the form of a reverse U-shape by a standing portion 9, a turned portion 8 and a hanging portion 10. Of course, the inside passage, i.e., the air suction passage, of the air suction pipe 3 has a reverse U-shape. The section shape of the inside passage of the air suction pipe 3 may be circular or polygonal. Alternately, the respective portions of inside passage at the standing portion 9, the turned portion 8 and the hanging portion 10 may have different section shapes and diameters. A branch pipe 11 curved in a U-shape is branched from a suitable portion of the hanging portion 10 of the air suction pipe 3. A U-shape branch passage 21 is formed inside of the branch pipe 11 and communicates with the inside passage of the air suction pipe 3. The branch passage 21 has an end opening 12 which is located in a position higher than the lowest water level LWL of the vertical pump. This embodiment shown in FIG. 1 is arranged such that the level at which the branch pipe 11 is branched from the hanging portion 10, and the level at which the air suction pipe 3 is connected to the suction casing 2, are substantially the same as the level of the end opening 12. Further, the inside passage of the hanging portion 10 has a lower end opening 22 which is located in a position lower than the lowest water level LWL. The turned portion 8 of the reverse U-shape air suction pipe 3 is located in a position higher than the pumping head corresponding to a maximum negative pressure generated in an impeller chamber 6.

The term "lowest water level LWL" herein used has the same meaning as that described at the beginning of this specification, and therefore means the water level inherent in each pump where, if the water level is lower than a predetermined level, eddies are produced and the pump starts sucking air even though the suction port is submerged under water.

The following will discuss the respective operations of the vertical pump above-mentioned in the three cases, i.e., the case where the vertical pump starts operating, the case where the water level in a water pumping well P is raised from a position lower than the lowest water level LWL, and the case where the water level in the water pumping well P is lowered from a position higher than the lowest water level LWL.

(a) Where the vertical pump starts operating:

When the water level is located in a position lower than the end opening 12 of the U-shape passage 21, air is sucked from the end opening 12 to the impeller chamber 6 through the U-shape passage 21, the inside passage of the air suction pipe 3 and a communication port 20 through which the inside passage of the air suction pipe 3 communicates with the inside of the suction casing 2. Accordingly, when the vertical pump starts operating under the conditions above-mentioned, the air operation is carried out. On the other hand, when the vertical pump starts operating in the case where the water level is located in a position higher than the end opening 12 of the U-shape passage 21, the U-shape passage 21 is sealed with water to prevent air from being sucked to the impeller chamber 6. The self-priming of the impeller 1 causes water to be pumped up from the suction casing 2, thus carrying out the water pumping operation.

(b) Where the water level is raised from a position lower than the lowest water level LWL during the full-speed waiting operation:

When the water level does not reach the lower end opening 22 of the hanging portion 10, the end opening 12 of the branch passage 21 and the lower end opening 22 of the hanging portion 10 are opened. Therefore, according to the negative pressure in the impeller chamber 6, air is sucked, as shown by arrows a, b, from the end openings 12, 22 to the impeller chamber 6 through the U-shape passage 21, the hanging portion 10 and the communication port 20. Accordingly, no water is pumped up, but the air operation is continued.

While the end opening 12 of the branch passage 21 remains opened even though the water level reaches the lower end opening 22 of the hanging portion 10 so that the lower end opening 22 is sealed with water, air is sucked, as shown by the arrow a according to the negative pressure in the impeller chamber 6, from the end opening 12 to the impeller chamber 6 through the U-shape passage 21, the air suction pipe 3 and the communication port 20. Accordingly, water is still not pumped up but the air operation is continued. Such an air operation is continued until the water level reaches the end opening 12 of the U-shape passage 21.

When the water level $W_1$ reaches the end opening 12 of the branch passage 21 as shown by a virtual line in FIG. 1, the gravity or the negative pressure in the impeller chamber 6 causes water to flow from the end opening 12 into the U-shape passage 21, so that the branch passage 21 is sealed with water. This intercepts the air suction to the impeller chamber 6 through the air suction pipe 3. Accordingly, while the air remaining in the suction casing 2 is sucked by the self-priming of the impeller 1, the operation of the vertical pump is quickly changed to the water pumping operation. At the time when the residual air is perfectly sucked, a perfect water pumping operation starts. At this time, since the turned portion 8 of the air suction pipe 3 is located in a position higher than the pumping head corresponding to a maximum negative pressure generated in the impeller chamber 6, water is pumped up in the inside passage at the hanging portion 10 of the air suction pipe 3 to such a height as to be kept in equilibrium with the negative pressure in the impeller chamber 6. Accordingly, the water level $W_1$ at this time refers to a pumping starting water level RWL.

When the water level is located in a position higher than the pumping starting water level RWL, the water pumping operation is smoothly continued.

(c) Where the water level is lowered from a position higher than the lowest water level LWL during the full-speed waiting operation:

Before the water level reaches the pumping starting water level RWL, the water pumping operation which has been made up to that time, is continued. When the water level reaches the pumping starting water level RWL, the water pumping operation which has been made up to that time, is also continued.

When the level of water stored at the side of the end opening 12 of the U-shape branch passage 21 is lowered to a position slightly lower than a turned portion 13 of the branch pipe 11 with the descent of the water level to a position lower than the pumping starting water level RWL, the water column formed in the branch passage 21 and the inside passage of the hanging portion 10 is ill-balanced, thereby to release the water sealing of the branch passage 21. When the water sealing is thus released, the negative pressure in the impeller chamber 6 causes air to be sucked from the end opening 12 to the impeller chamber 6 through the branch passage 21, the air suction pipe 3 and the communication port 20. When the air is thus sucked in the impeller chamber 6, the water pumping operation made in the suction casing 2 and the like is stopped with such air suction, so that the pumping operation is quickly and smoothly changed to the air operation. Accordingly, the water level at this time refers to a pumping stopping water level SWL. The pumping stopping water level SWL is set to a level identical with or in the vicinity of the lowest water level LWL. As shown in FIG. 1, the turned portion 13 of the U-shape branch pipe 11 may have an inner diameter slightly greater than that of each of other portions of the branch passage 21. Such an arrangement prevents the water remaining in the branch passage 21 at the time when the pumping operation is stopped, from impeding the inflow of air, thus further assuring the water pumping stopping operation.

When the water pumping is stopped, a portion of the water forming the water column in the branch passage 21 and the hanging portion 10 of the air suction pipe 3 accompanies air and is pumped up to the impeller chamber 6. Other water portion which does not accompany the air, falls in the inside passage of the hanging portion 10 and is returned to the water pumping well P.

As apparent from the foregoing, in the vertical pump above-mentioned, the pumping starting water level RWL serving as a reference water level at which the air operation is changed to the water pumping operation, is equal to or higher than the level of the end opening 12 of the U-shape branch passage 21, while the pumping stopping water level SWL serving as a reference water level at which the water pumping operation is changed to the air operation, is the same as or in the vicinity of the lowest water level LWL which is lower than the level of the end opening 12 of the branch passage 21. Further, it is possible to increase or decrease the difference between the pumping starting water level RWL and the pumping stopping water level SWL by adjusting the level of the end opening 12 and the turned portion 13 of the U-shape branch passage 21. Accordingly, proper setting of these levels securely may prevent the occurrence of the hunting phenomenon mentioned earlier.

Figure 2:
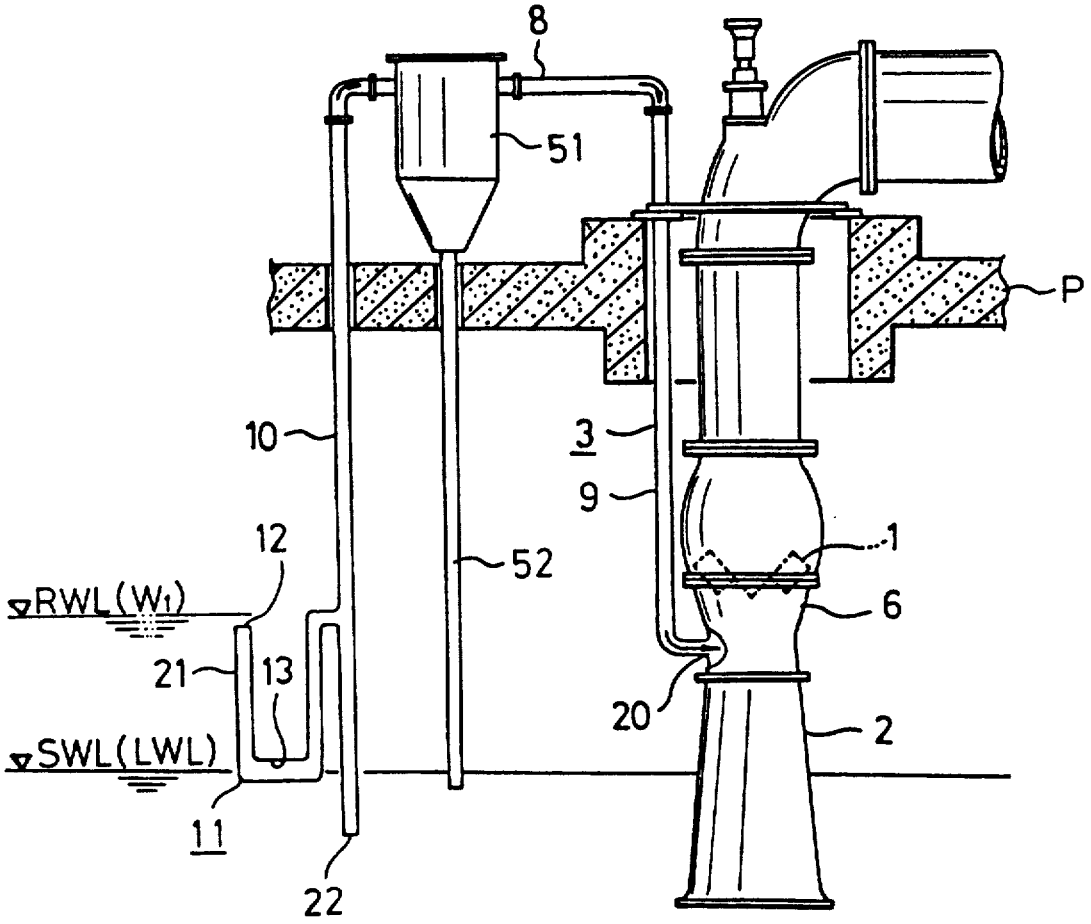
FIG. 2 is a schematic view illustrating the arrangement of a vertical pump in accordance with another embodiment of the present invention.

Preferably, a hermetically sealed tank 51 having at the bottom a drain pipe 52 connected thereto may be interposed at the turned portion 8 of the air suction pipe 3 as is the case of a vertical pump shown in FIG. 2. When such a hermetically sealed tank 51 is disposed, the air and water coming up through the hanging portion 10 of the air suction pipe 3 at the time when the water pumping operation is stopped, are separated from each other in the hermetically sealed tank 51. The water is then received at a tank portion lower than the level of the turned portion 8 and is returned to the water pumping well P through the drain pipe 52. Such an arrangement prevents the vertical pump from being vibrated due to the water/air mixture sucked into the impeller chamber 6. Other parts of the vertical pump shown in FIG. 2 are the same as those of the vertical pump in FIG. 1. Accordingly, like parts in FIG. 2 are designated by like reference numerals used in FIG. 1 and a detailed description thereof is here omitted.

In the vertical pump shown in FIG. 1, the U-shape branch passage 21 is formed by the branch pipe 11 curved in the form of a U-shape. However, the U-shape passage is not necessarily formed by a curved pipe.

Figure 3A:
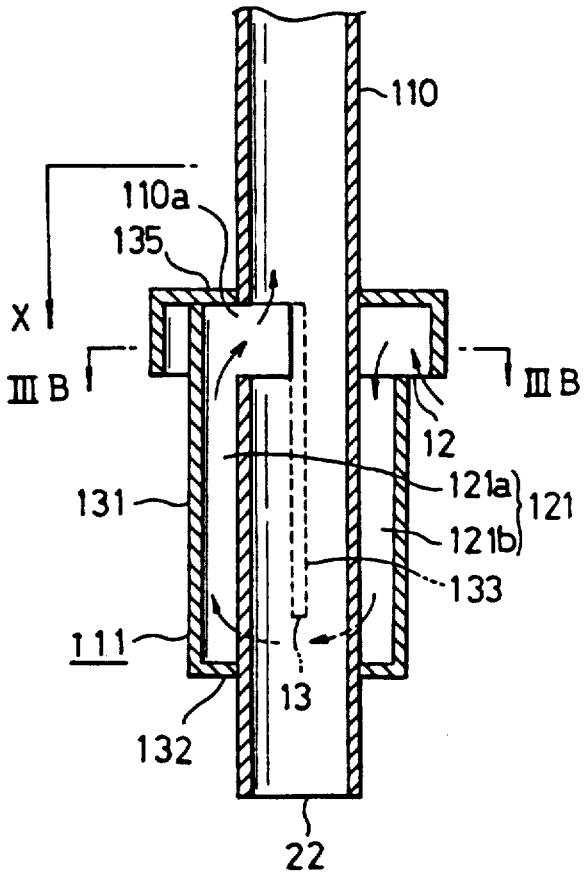
FIG. 3A is a section view of another example of the branch passage of the vertical pump in FIG. 1.
Figure 3B:
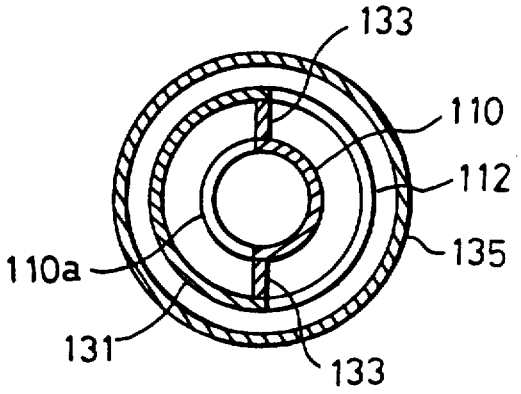
FIG. 3B is a section view taken along the line IIIB—IIIB of FIG. 3A.

FIGS. 3A and 3B show a vertical pump in which a U-shape branch passage 121 is formed by other member than a pipe. The member 111 forming the branch passage 121 includes a cylindrical portion 131, a bottom plate 132, a cover 135 and two partitioning plates 133. The cylindrical portion 131 surrounds a suitable portion of a hanging portion 110 with a distance provided between the cylindrical portion 131 and the suitable portion of the hanging portion 110. The cylindrical portion 131 is provided in a semi-circular portion of the upper end thereof with a notch of predetermined sizes. The bottom plate 132 closes the lower end of the cylindrical space formed between the cylindrical portion 131 and the hanging portion 110. The cover 135 is made in the form of a lid of which diameter is greater than that of the cylindrical portion 131 and which is opened at the lower end thereof. The cover 135 is externally fitted and secured to the hanging portion 110, and is also secured to the upper end edge of that part of the cylindrical portion 131 which is not notched. The two partitioning plates 133 are vertically disposed between the cylindrical portion 131 and the hanging portion 110. The partitioning plates 133 are secured, at the upper ends thereof, to the inner surface of the cover 135 and are separated, at the lower ends thereof, from the bottom plate 132. Accordingly, the partitioning plates 133 partition the space formed between the cylindrical portion 131 and the hanging portion 110, into two space portions 121*a*, 121*b* which communicate with each other at the lower ends thereof. These space portions 121*a*, 121*b* form the U-shape branch passage 121 with the space between the lower end of the partitioning plates 133 and the bottom plate 132 serving as a turned portion 113. The upper portion of one space portion 121*a* forming the branch passage 121 communicates with the inside passage, i.e., the air suction passage, of the hanging portion 110 through an opening 110*a* formed in the hanging portion 110. As apparent from FIG. 3A, the opening 110*a* is formed in that part of the hanging portion 110 which is opposite to that part of the upper end of the cylindrical portion 131 which is not notched. Thus, the upper end of the space portion 121*a* communicates with only the inside passage of the hanging portion 110. The upper end of the other space portion 121*b* forming the U-shape passage 121 is opposite to the notched part of the upper end of the cylindrical portion 131 and communicates with the air through the notch. As apparent from the foregoing, the end opening 112 of the U-shape passage 121 is downwardly opened between the cylindrical portion 131 and the cover 135. Likewise in the vertical pump in FIG. 1, the end opening 112 is opened at a position higher than the lowest water level LWL of the vertical pump in FIG. 3A, while the lower end opening 122 of the hanging portion 110 is located in a position lower than the lowest water level LWL. The air suction pipe having the hanging portion 110 is the same as that of the vertical pump in FIG. 1, except for only that portion of the air suction pipe at which the branch passage is branched. Accordingly, the entire air suction pipe is not shown in FIG. 3A.

With the use of the member 111 having the arrangement above-mentioned, the end opening 112 of the branch passage 121 is downwardly opened. Accordingly, when the water level is lowered from a position higher than the end opening 112, foreign matter floating on the water surface such as vinyl pieces, dust or the like, hardly closes or enters the end opening 112. This may prevent the end opening 112 from being clogged or closed so that the vertical pump is functionally disordered. This is an extremely great advantage in that the vertical pump is required to cope with an unexpected flood or the like. In the vertical pump in FIG. 3A, the member 111 less projects transversely of the hanging portion 110, as compared with the branch passage 21 formed by a curved pipe in the vertical pump as discussed with reference to FIG. 1. It is therefore possible to assemble the vertical pump in a compact manner, thus improving the appearance. Other operations of the vertical pump in FIG. 3A are the same as those of the vertical pump discussed with reference to FIG. 1.

In the vertical pump in FIG. 3A, the space formed between the cylindrical portion 131 and the hanging portion 110 may be divided into three or more space portions which communicate with one another at the lower ends thereof. In such an arrangement, it is enough if the upper end of at least one space portion communicates with only the air suction passage, and the upper end of at least one of other space portions communicates with the atmosphere.

In the vertical pump in FIG. 3A, the part which is located below an arrow X, may be formed as a unit, and this unit may be connected to the hanging portion 110.

Figure 4A:
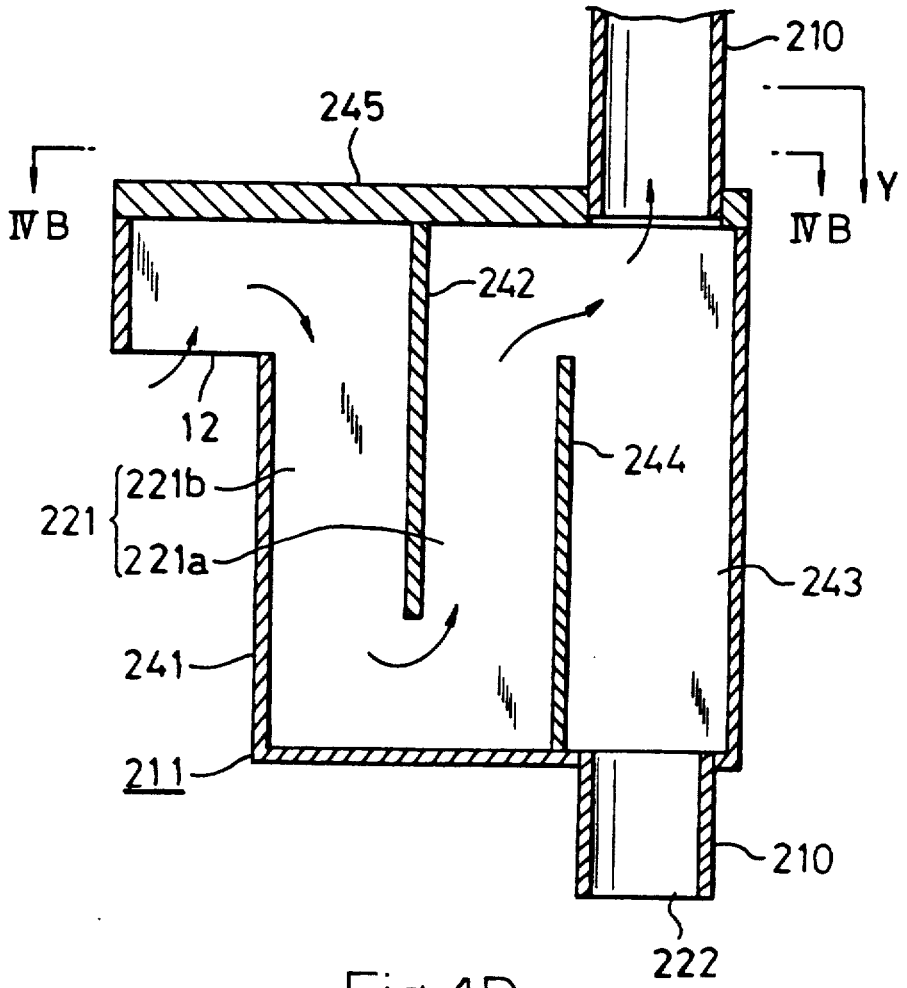
FIG. 4A is a further example of the branch passage of the vertical pump in FIG. 1.
Figure 4B:
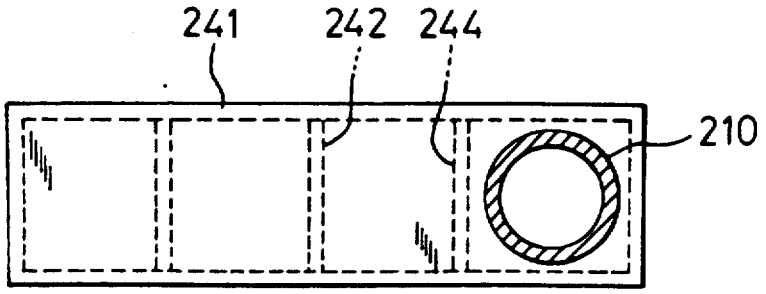
FIG. 4B is a section view taken along the line IVB—IVB of FIG. 4A.

FIGS. 4A and 4B show another member 211 forming a branch passage 221. This member 211 includes a box-type casing 241, a first partitioning plate 242, a second partitioning plate 244 and a cover 245. The box-type casing 241 is attached to the lower end of a hanging portion 210 and has a bottom. The first partitioning plate 242 is disposed inside of the box-type casing 241 and partitions the inside space thereof, thus forming the U-shape branch passage 221. The second partitioning plate 244 is disposed in the inside space of the box-type casing 241, and communicates with the upper portion of one passage portion 221*a* of the branch passage 221 partitioned by the first partitioning plate 242. Also, the second partitioning plate 244 forms a vertical passage 243 for downwardly extending the inside passage of the hanging portion 210. The cover 245 is attached and secured to the hanging portion 210 and closes the upper opening of the box-type casing 211. In the member 211, the end opening 212 of the branch passage 221 is downwardly opened between the box-type casing 241 and the cover 245, and communicates with the upper portion of the other space portion 221*b* forming the branch passage 221. An opening 243*a* is formed in the bottom of the box-type casing 241 at the position thereof opposite to the lower end of the vertical passage 243. This opening 243*a* communicates with the lower open end 222 of the hanging portion 210 which downwardly extends. Likewise in the vertical pump in FIG. 1, the end opening 212 of the vertical pump in FIG. 4A is opened at a position higher than the lowest water level LWL of the vertical pump in FIG. 4A, and the lower end opening 222 of the hanging portion 210 is located in a position lower than the lowest water level LWL. The air suction pipe having the hanging portion 210 is the same as that of the vertical pump in FIG. 1, except for only that portion of the air suction pipe at which the branch passage is branched. Accordingly, the entire air suction pipe is not shown in FIG. 4A.

With the use of the member 211 having the arrangement above-mentioned, the end opening 212 of the branch passage 221 is downwardly opened. Accordingly, likewise in the branch passage 121 discussed with reference to FIGS. 3A and 3B, foreign matter floating on the water surface such as vinyl pieces, dust or the like, hardly closes or enters the end opening 212. This may prevent the end opening 212 from being clogged so that the vertical pump is functionally disordered. In the vertical pump in FIG. 4A, the member 211 less projects transversely of the hanging portion 210, as compared with the U-shape branch passage 21 formed by a curved pipe in the vertical pump as discussed with reference in FIG. 1. It is therefore possible to assemble the vertical pump in a compact manner, thus presenting an advantage of favorable appearance. Other operations of the vertical pump in FIG. 4A are the same as those of the vertical pump discussed with reference to FIG. 1.

In the vertical pump in FIG. 4A, the part which is located below an arrow Y, may be formed as a unit, and this unit may be connected to the hanging portion 210.

Arrows shown in FIGS. 3A and 4A represent the directions of air flow during the air operation and at the time when the water pumping operation is stopped.

Figure 5:
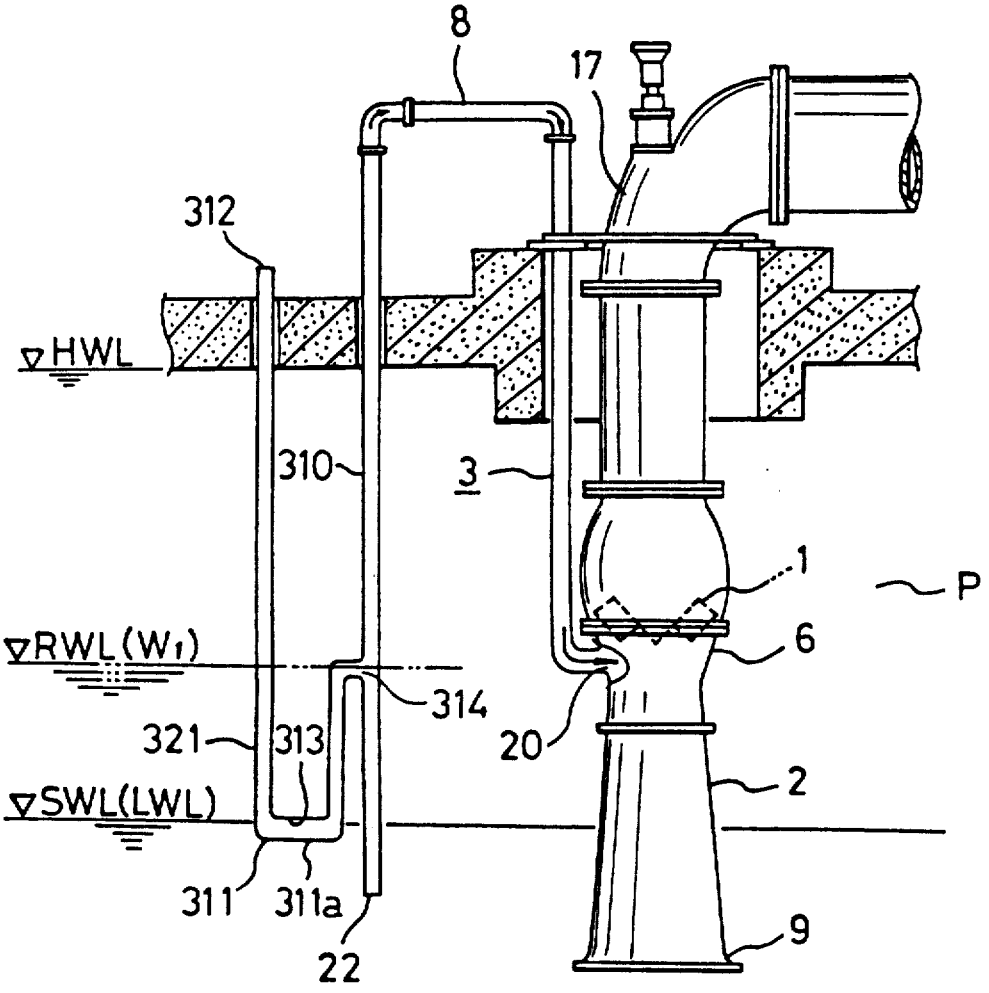
FIG. 5 is a schematic view illustrating the arrangement of a vertical pump in accordance with a further embodiment of the present invention.

FIG. 5 shows a vertical pump in accordance with still another embodiment of the present invention. The vertical pump in FIG. 5 has an arrangement similar to that of the vertical pump shown in FIG. 1. In the vertical pump in FIG. 5, however, the end opening 312 of a branch passage 321 having a U-shape portion is located in a position higher than the highest water level HWL of a water pumping well P in which the vertical pump is installed. In this point only, the vertical pump in FIG. 5 is different from the vertical pump in FIG. 1. That is, except for a branch pipe 311 forming the branch passage 321, the vertical pump in FIG. 5 has the arrangement perfectly identical with that of the vertical pump in FIG. 1. Accordingly, such like parts are designated by like reference numerals and are not here discussed in detail.

In the vertical pump in FIG. 5, the pumping starting water level RWL is equal to or higher than the level of a branch portion 314 at which the branch passage 321 is branched from an air suction passage 310. More specifically, when the water level not higher than the lowest water level LWL is raised and reaches the level of the branch portion 314, water flows into the branch passage 321 through the branch portion 314 so that the branch passage 321 is sealed with water. This intercepts the air suction to the impeller chamber 6. While the air remaining in the suction casing 2 is sucked, the operation of the vertical pump is changed to the water pumping operation. The vertical pump in FIG. 5 is operated in the same manner as in the vertical pump in FIG. 1, except that the pumping starting water level RWL is equal to or higher than the level of the branch portion 314 (not the level of the end opening 312) of the branch passage pipe 321. Thus, the vertical pump in FIG. 5 may achieve the full-speed operation at all times.

Figure 6A:
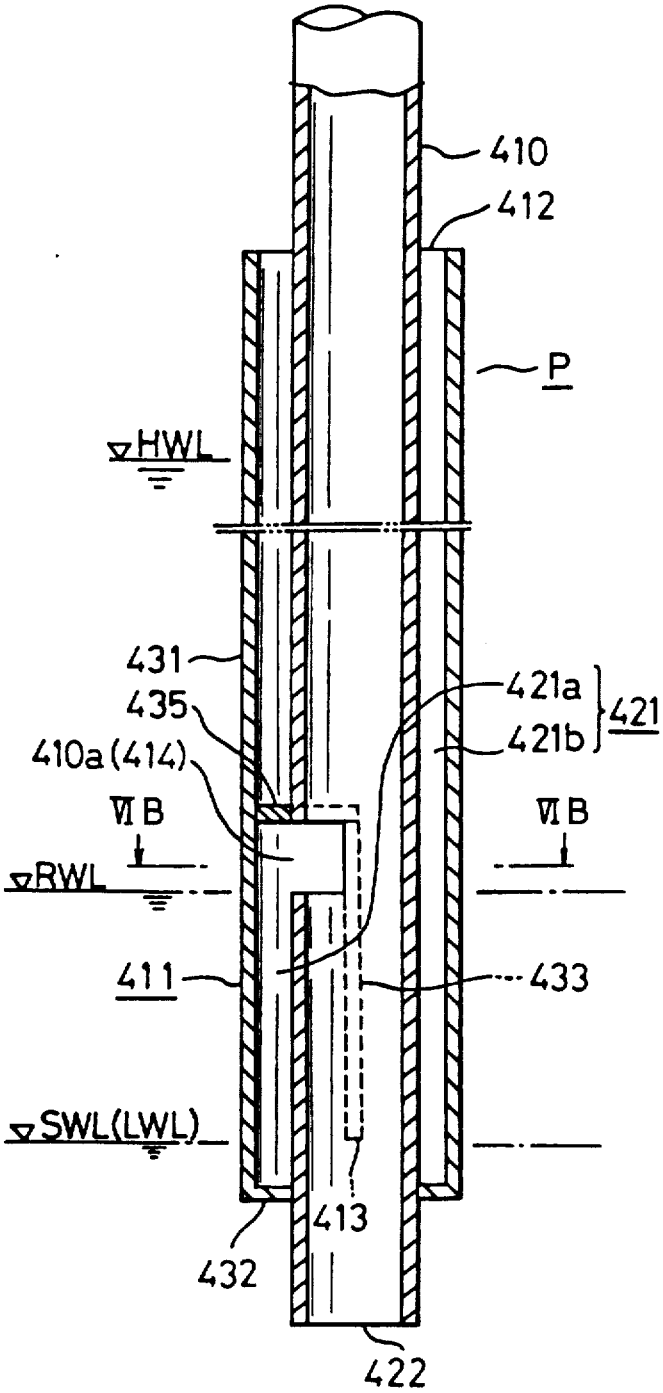
FIG. 6A is a section view of another example of the branch passage of the vertical pump in FIG. 5.
Figure 6B:
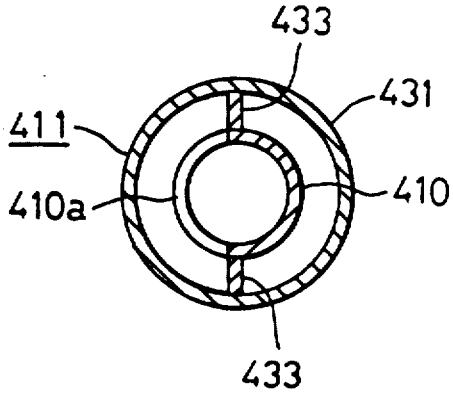
FIG. 6B is a section view taken along the line VIB—VIB in FIG. 6A.
Figure 7:
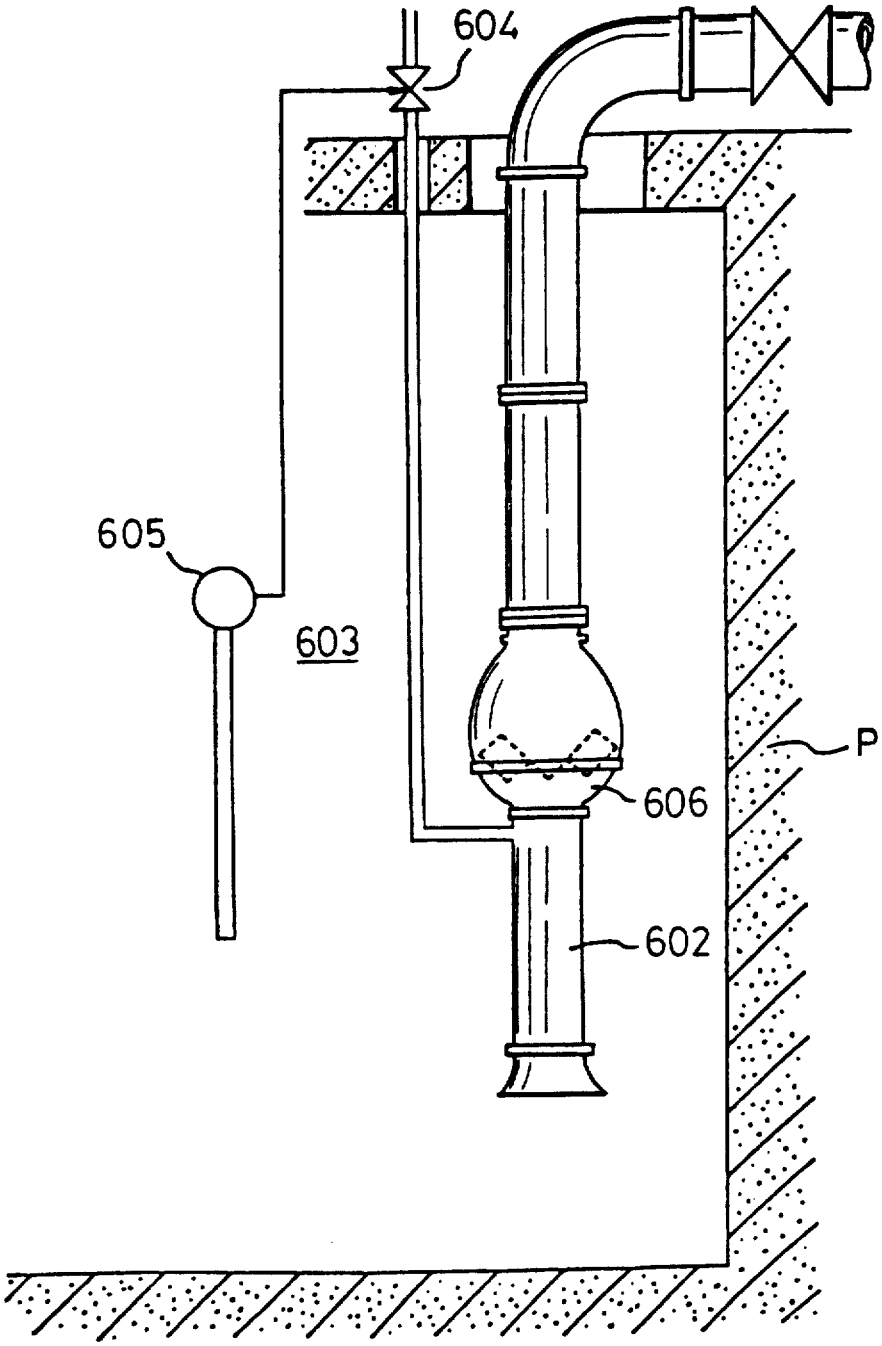
Fig.7 (Prior Art)
FIG. 7 is a view illustrating a conventional vertical pump.
Figure 8:
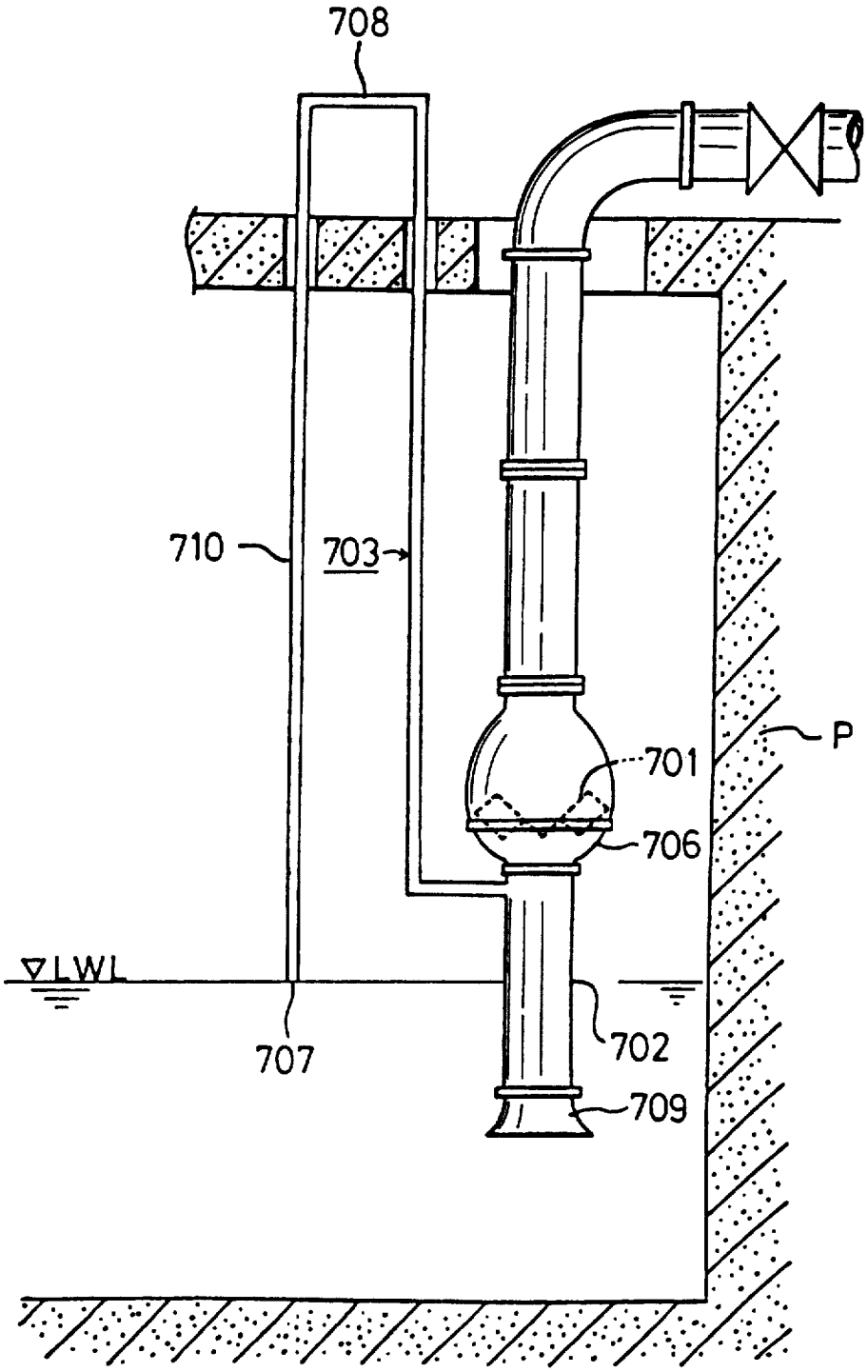
FIG. 8 is a view illustrating a vertical pump which is not known but on which the vertical pump of the present invention is based.

FIG. 6 shows a branch passage 421 formed by other member than a pipe. Likewise the branch passage 321 in FIG. 5, this branch passage 421 has an end opening 412 located in a position higher than the highest water level HWL of the vertical pump. The branch passage 421 has an arrangement similar to that of the branch passage shown in FIGS. 3A and 3B. More specifically, two space portions **421*a*, 421*b* communicating with each other at the lower ends thereof are formed by (i) a cylindrical portion 431 surrounding a hanging portion 410 forming an air suction passage, (ii) a bottom plate 432 which closes the lower end of the space formed between the cylindrical portion 431 and the hanging portion 410 and (iii) partitioning plates 433 vertically disposed between the cylindrical portion 431 and the hanging portion 410. These space portions 421*a*, 421*b* form the branch passage 421. The upper end of one space portion 421*a* communicates with the air suction passage through an opening 410*a*. However, the branch passage 421 in FIG. 6 does not have a large-diameter cover such as the cover 135 shown in FIG. 3A, and the upper end of the cylindrical portion 431 is not notched. In the branch passage 421 in FIG. 6, the cylindrical portion 431 generally extends to a position higher than the highest water level HWL, and there is disposed a semi-annular lid 435 which closes the space portion 421*a* above an opening 410*a*. In the branch passage in FIG. 6, the upper end opening of the cylindrical portion 431 forms an end opening 412 of the branch passage 421. The opening 410*a* serves as a branch portion of the branch passage 421, and the pumping starting water level RWL is equal to or higher than the level of the lower end of the opening 410*a*. The vertical pump having the branch passage 421 as shown in FIG. 6 may be operated in the same manner as in the vertical pump in FIG. 5**.

In the embodiments above-mentioned, each of the air suction passage is entirely formed by a pipe. However, the whole or a part of the air suction passage may be formed as a passage which passes through a block such as the inside of the wall of a water pumping well or the like. In the vertical pump in each of FIG. 3A, 4A and 6A, it is required to form the lower portion of the hanging portion of the air suction passage by a pipe.

What is claimed is:

1. A vertical pump comprising:

an air suction passage in the form of a reverse U-shape formed by a standing portion, a turned portion and a hanging portion, the entire peripheral surface of said air suction passage being closed, said standing portion being connected, at the lower end thereof, to a suction casing which communicates with an impeller chamber, the lower end opening of said hanging portion being located in a position lower than the lowest water level of said vertical pump, said turned portion being located in a position higher than the pumping head corresponding to a maximum negative pressure generated in said impeller chamber; and a branch passage having a U-shape portion and branched from said hanging portion of said air suction passage, the end opening of said branch passage being located in a position higher than said lowest water level of said vertical pump.

2. A vertical pump according to claim 1, wherein said branch passage is formed by a pipe curved into a U-shape.

3. A vertical pump according to claim 1, wherein at least the lower part of the hanging portion of the air suction passage is formed by a pipe, comprising:

a casing portion surrounding a portion of said pipe forming said hanging portion of said air suction passage with a distance provided between said pipe and said casing portion;

a bottom plate which closes the lower end of a casing space formed between said casing portion and said tube; and partitioning plates disposed between said casing portion and said pipe for dividing said space into a plurality of space portions with the lower ends of said partitioning plates separated from said bottom plate;

the upper end of at least one of said space portions communicating with only the air suction passage in said pipe, the upper end of at least one of other space portions being opened in the air, said two space portions forming said branch passage.

4. A vertical pump according to claim 3, wherein the end opening of the branch passage communicating with the upper end of the space portion which is opened in the air, is downwardly opened between a cover secured to the pipe and the casing portion.

5. A vertical pump according to claim 1, wherein at least the lower part of the hanging portion of the air suction passage is formed by a pipe, comprising:

a box-type casing attached to said pipe forming said hanging portion of said air suction passage, said box-type casing having a bottom;

a first partitioning plate disposed inside of said box-type casing for dividing the inside space thereof to form the branch passage;

a second partitioning plate disposed inside of said box-type casing for forming a vertical passage which communicates with the upper part of one portion of said branch passage formed as partitioned by said first partitioning plate and which is formed for downwardly extending said hanging portion of said air suction passage;

a cover secured to said pipe for closing the upper opening of said box-type casing; and an opening formed in the bottom of said box-type casing, said opening forming the lower end opening of said hanging portion which downwardly extends through said vertical passage, or said opening communicating with said lower end opening.

6. A vertical pump according to claim 5, wherein the end opening of the branch passage is downwardly opened.

7. A vertical pump according to claim 1, wherein a plurality of air suction passages are disposed.

8. A vertical pump according to claim 1, wherein an air/water separation tank is disposed at the turned portion of the air suction passage.

9. A vertical pump according to claim 1, wherein the air suction passage has a circular section.

10. A vertical pump according to claim 1, wherein the air suction passage has a polygonal section.

11. A vertical pump according to claim 1, wherein the standing portion, the turned portion and the hanging portion of the air suction passage have sections in different shapes, respectively.

12. A vertical pump according to claim 2, wherein the branch passage has a circular section.

13. A vertical pump according to claim 2, wherein the branch passage has a polygonal section.

14. A vertical pump according to claim 2, wherein the turned portion of the branch passage has a diameter greater than that of each of other portions of said branch passage.

15. A vertical pump according to claim 1, wherein the end opening of the branch passage is set to a height substantially equal to the height of that portion of said branch passage which is branched from the air suction passage, and to the height of that portion of said air suction passage which is connected to the suction casing.

16. A vertical pump according to claim 1, wherein the end opening of the branch passage is located in a position higher than the highest water level in a water pumping well in which said vertical pump is installed.

17. A vertical pump according to claim 16, wherein that portion of the branch passage which is branched from the air suction passage is set to a height substantially equal to the height of that portion of said air suction passage which is connected to the suction casing.

* * * * *